US009707145B2

(12) United States Patent
Joung

(10) Patent No.: US 9,707,145 B2
(45) Date of Patent: Jul. 18, 2017

(54) INVERSION EXERCISE MACHINE HAVING A CHAIR FUNCTION

(71) Applicant: Tae Geun Joung, Daegu (KR)

(72) Inventor: Tae Geun Joung, Daegu (KR)

( * ) Notice: Subject to any disclaimer, the term of this patent is extended or adjusted under 35 U.S.C. 154(b) by 0 days.

(21) Appl. No.: 14/782,580

(22) PCT Filed: Mar. 20, 2014

(86) PCT No.: PCT/KR2014/002331

§ 371 (c)(1),
(2) Date: Oct. 5, 2015

(87) PCT Pub. No.: WO2014/171637

PCT Pub. Date: Oct. 23, 2014

(65) Prior Publication Data

US 2016/0038367 A1 Feb. 11, 2016

(30) Foreign Application Priority Data

Apr. 15, 2013 (KR) ..... 10-2013-0040890
Mar. 19, 2014 (KR) ..... 10-2014-0032115

(51) Int. Cl.

| | |
|---|---|
| ***A47C 13/00*** | (2006.01) |
| ***A63B 26/00*** | (2006.01) |
| ***A61H 1/02*** | (2006.01) |
| ***A47C 1/032*** | (2006.01) |
| ***A47C 1/035*** | (2006.01) |
| ***A47C 9/00*** | (2006.01) |

(52) U.S. Cl.

CPC ..... *A61H 1/0229* (2013.01); *A47C 1/035* (2013.01); *A47C 1/03211* (2013.01);
(Continued)

(58) Field of Classification Search

CPC . A63B 21/02; A63B 21/0205; A63B 21/0211; A63B 21/0216; A63B 21/0222; A63B 21/0227; A63B 21/0233; A63B 21/0238; A63B 7/00; A63B 21/068; A63B 2208/0285; A63B 2208/029; A63B 23/02; A63B 23/0205; A63B 23/0211; A63B 23/0216; A63B 23/0222; A63B 23/0227; A63B 23/0233; A63B 23/0238; A61H 1/02; A61H 1/0218; A61H 1/0229; A61H 1/0292; A61H 2203/0493; A47C 9/002; A47C 1/035; A47C 1/032; A47C 1/03205; A47C 1/030211
(Continued)

(56) References Cited

U.S. PATENT DOCUMENTS 2,195,091 A * 3/1940 Lorenz ..... A47C 1/035 297/27
5,348,367 A * 9/1994 Mizelle ..... A47C 1/035 297/321
(Continued)

FOREIGN PATENT DOCUMENTS

JP 3045527 U9 11/1997
JP 2007-202862 A 8/2007
(Continued)

*Primary Examiner* — Nyca T Nguyen
(74) *Attorney, Agent, or Firm* — Patent Office of Dr. Chung Park

(57) ABSTRACT

The present invention relates to an inversion exercise machine having a rocking-chair function. An inversion exercise machine having a chair function has been developed that can combine the functions of inverted exercise and a chair, such that the invention can be transformed into an inversion exercise machine from being used as a chair; the invention being easy to use and the versatility of the machine being enhanced.

5 Claims, 19 Drawing Sheets

(52) U.S. Cl.
CPC ..... *A47C 9/002* (2013.01); *A61H 1/0292* (2013.01); *A61H 2201/1633* (2013.01); *A61H 2201/1642* (2013.01); *A63B 2208/0285* (2013.01)

(58) Field of Classification Search
USPC ..... 297/118, 130, 131, 133, 259.1–259.3
See application file for complete search history.

(56) References Cited

U.S. PATENT DOCUMENTS

| | | | | |
|---|---|---|---|---|
| 7,361,128 | B2 * | 4/2008 | Chen | A61H 1/0218 482/142 |
| 2003/0162639 | A1 * | 8/2003 | Hsien | A63B 21/068 482/144 |
| 2006/0046915 | A1 * | 3/2006 | Huang | A61H 1/0218 482/145 |
| 2008/0054686 | A1 * | 3/2008 | Castagnola | A47C 1/035 297/30 |
| 2008/0061615 | A1 * | 3/2008 | McBride | A47C 1/02 297/325 |

FOREIGN PATENT DOCUMENTS

| | | | |
|---|---|---|---|
| KR | 10-2006-0027454 | A | 3/2006 |
| KR | 20-0421758 | Y1 | 7/2006 |
| KR | 10-1124662 | B1 | 2/2012 |
| KR | 20-0460098 | B1 | 4/2012 |
| KR | 10-1167684 | B1 | 7/2012 |
| KR | 10-1265181 | B1 | 6/2013 |

* cited by examiner

INVERSION EXERCISE MACHINE HAVING A CHAIR FUNCTION

CROSS-REFERENCE TO PRIOR APPLICATIONS

This application is a national Stage Patent Application of PCT International Patent Application No. PCT/KR2014/002331, filed on Mar. 20, 2014 under 35 U.S.C. §371, which claims priority of Korean Patent Application No. 10-2013-0040890, filed on Apr. 15, 2013 and No. 10-2014-0032115, filed on Mar. 19, 2014, which are all hereby incorporated by reference in their entirety.

TECHNICAL FIELD

The present invention relates to an inversion exercise apparatus having a rocking chair function, and more particularly, to an inversion exercise apparatus having a chair, which is transformed into the inversion exercise apparatus and enables a user to perform upside-down exercise, if necessary, while having a rocking chair or swivel chair function that enables a user to comfortably sit thereon.

BACKGROUND ART

Generally, the apparatus called 'inversion table' is developed as a stretching apparatus for relieving pain of lumbar disc that occurs because human walks elect.

That is, the inversion table relieves tension of the spine by allowing a user to hang upside down while fixing the ankle of the user, and corrects the spine by allowing the spine to hang down. Thus, the pain of lumbar disc is alleviated, or the abdominal muscle is strengthened.

However, since the inversion exercise apparatus is an exercise machine that allows a user to hang upside down while fixing the ankle of the user, the inversion exercise apparatus needs a stable structure, and the volume of the exercise apparatus is large. Also, since the apparatus is configured to rotate such that a user hangs upside down while standing straight and leaning on the back plate of the apparatus, a sufficient space is needed for the radius of rotation of the back plate. Accordingly, there is a limitation in that it is difficult to install the inversion exercise apparatus in an office or home having a low ceiling or small space.

Also, since a typical inversion apparatus is developed for upside-down exercise, it is difficult to change its use.

DISCLOSURE

Technical Problem

Accordingly, the present disclosure provides an inversion exercise apparatus having a chair function, which can be transformed from a chair to an inversion table so as to have both inversion exercise and chair functions and thus improve the convenience and utilization of the apparatus.

Technical Solution

In one general aspect, an inversion exercise apparatus having a chair function includes:

a stand (1) including a first support (101) and a second support (102) parallelly disposed in a vertical direction at both left and right sides of the stands (1), the first support (101) being longer than the second support (102);

an armrest (2) pivotably disposed on a pivot (101*a*) disposed at an upper end portion of the first support (101), including a first connector (201) disposed at a rear end portion of the armrest (2) and pivotably connected to connectors disposed at left and right sides of a central portion of a backrest (3) having a rectangular frame structure, and including a second connector 202 disposed at a front end portion of the armrest (2) and pivotably connected to an upper end portion of vertical connection rods (4*a* and 4*b*) disposed at left and right sides of a horizontal connection rod (4) at a front side of a seat rod;

a horizontal connection rod (4) disposed at the front side of the seat rod such that the upper end portions of the both vertical connection rods (4*a* and 4*b*) are connected to the second connector (202) and lower connectors (4*c* and 4*d*) of the vertical connection rod are pivotably connected to a third connector (501);

a seat rod (5) including the third connector disposed at the front end portion thereof so as to be pivotably connected to the lower connector (4*c*) of the vertical connection rod and including a fourth connector disposed at a rear end portion thereof so as to be pivotably connected to left and right lower end portions of the backrest (3);

a rotational link (503) connected to the fourth connector (502) of the seat rod and a bracket (102*a*) of the first support (101);

a gap maintaining member (504) disposed on the third connector (501) and the fourth connector (502) of the seat rod;

a footrest (6) including a fixing rod (401) disposed in a vertical direction under the center of the horizontal connection rod (4) and having fixing holes (401*a*) at a certain interval, the fixing rod (401) inserted into a coupling rod (601), a fixing pin (601*a*) inserted into the fixing hole (401*a*) to fix the location of the coupling rod (601), four ankle fixing rollers (601*b*) disposed at certain intervals under the coupling rod (601) such that a user hangs and fixes both ankles thereon, and a foothold (601*c*) disposed at both sides of a lower end portion of the coupling rod (601);

a first gear (103) fixed on a rotation axis formed on the bracket (102*a*) formed on the first support (101);

an operation lever (104) disposed integrally with the rotation axis of the first gear (103);

a second gear (503*a*) disposed at one side of the first gear (103) disposed on the bracket (102*a*) to engage with the first gear (103); and a driving device including the rotational link (503) connecting the rotation axis of the second gear and the fourth connector (502).

The first gear (103) may include a disc and a chain fixedly covering an outer circumference of the disc, and the second gear (503*a*) may include a chain sprocket.

The first gear (103) may include a worm wheel (103') making contact with a worm screw (104) disposed on a drive shaft of a left-right rotation geared motor (M) equipped with left-right rotation switches (S1 and S2), and the inversion exercise apparatus may be operated by an electric device without the operation lever by connecting a rotational link (503') between the rotation axis of the worm wheel and the fourth connector (502).

When the first support (101) is disposed in a swivel chair, the first support (101) may lean to the backrest by about 5 degrees to about 6 degrees at both sides of a swivel chair stand (1'), and the inversion exercise apparatus may be operated by forming the bracket (102*a*) under the pivot (101*a*) and installing a worm wheel (103') and a worm screw (104') of a geared motor making contact with the worm wheel (103').

Other features and aspects will be apparent from the following detailed description, the drawings, and the claims.

Advantageous Effects

Thus, since the present invention has a four joint link structure including an armrest, a backrest, a horizontal connection rod, and a seat rod, the present invention can be easily transformed into an inversion exercise apparatus, and can be utilized as a chair. Also, the present invention is transformed into the inversion exercise apparatus, a manual operation device or a motor drive device can be used, and thus the present invention is convenient to use. The present invention can be used as inversion exercise as well as a swivel chair in addition to a rocking chair.

BEST MODE

Figure 1:
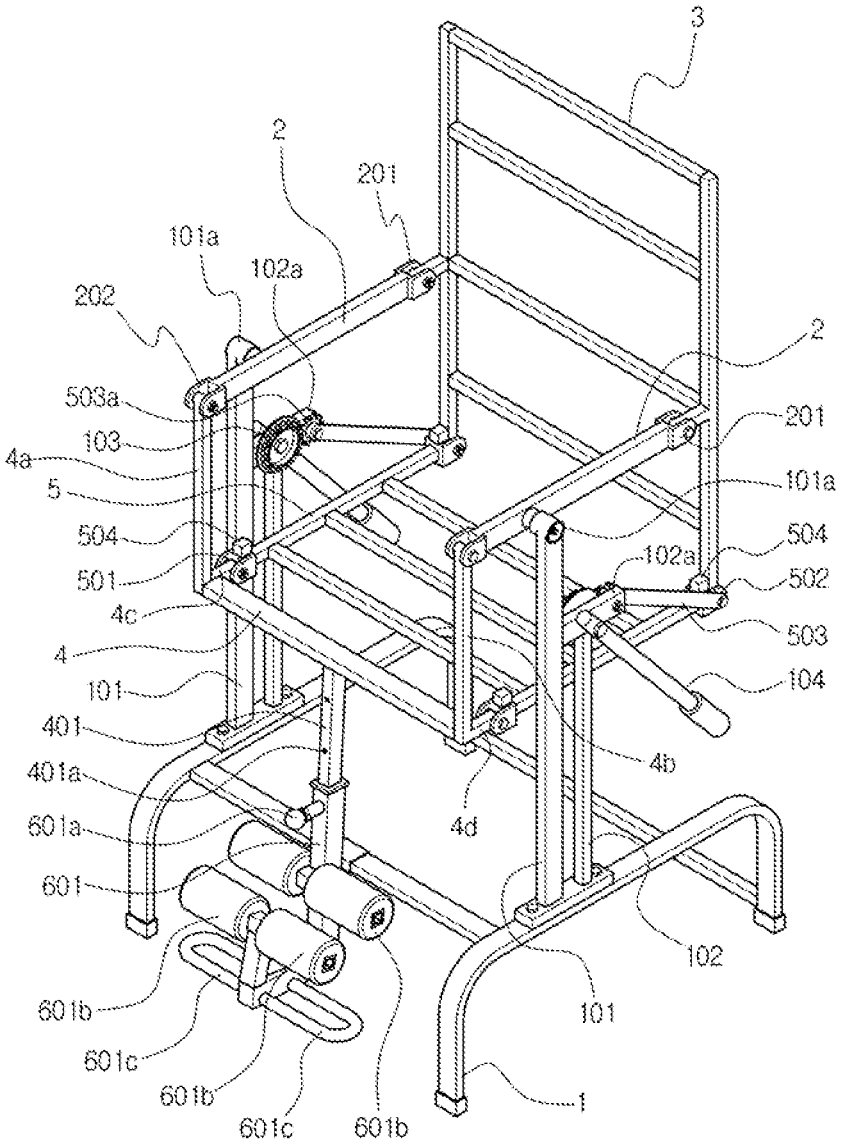
FIG. 1 is a perspective view illustrating an inversion exercise apparatus implemented into a rocking chair according to an embodiment of the present invention.
Figure 2:
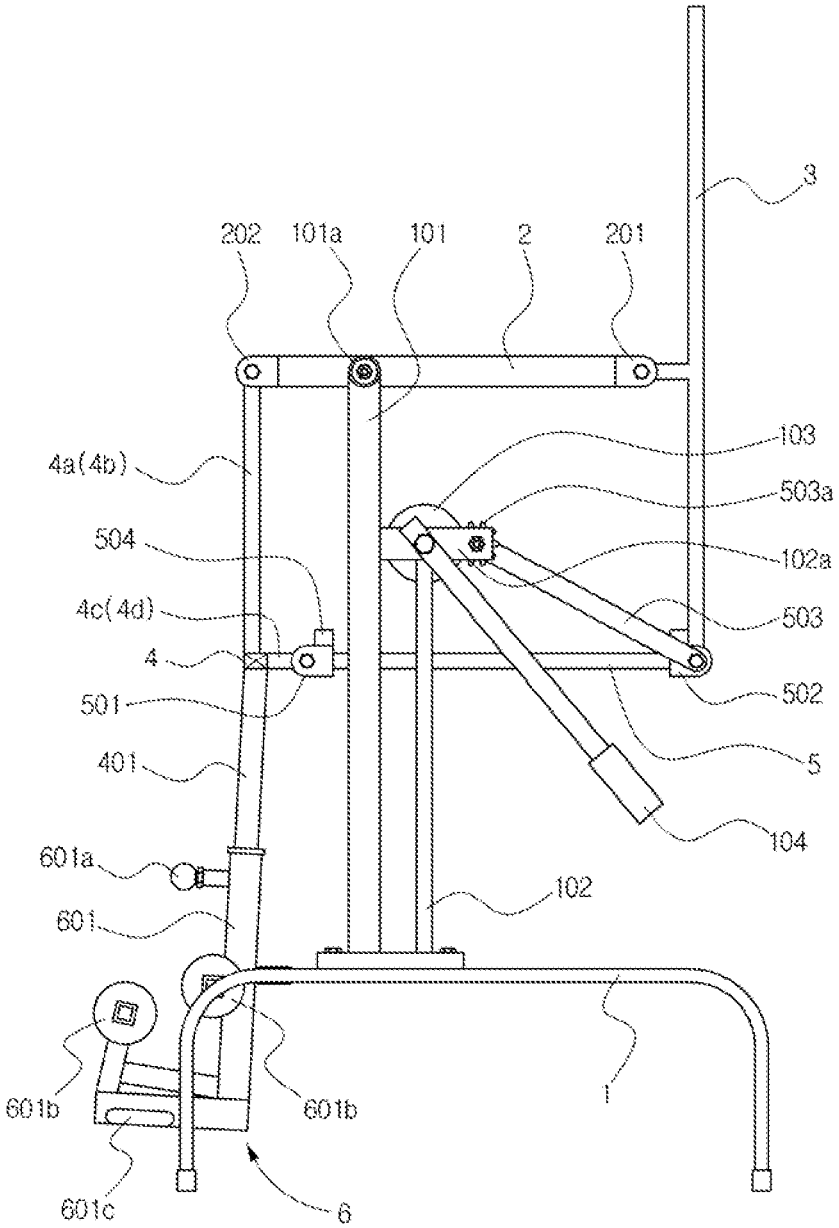
FIG. 2 is a side view of FIG. 1.
Figure 3:
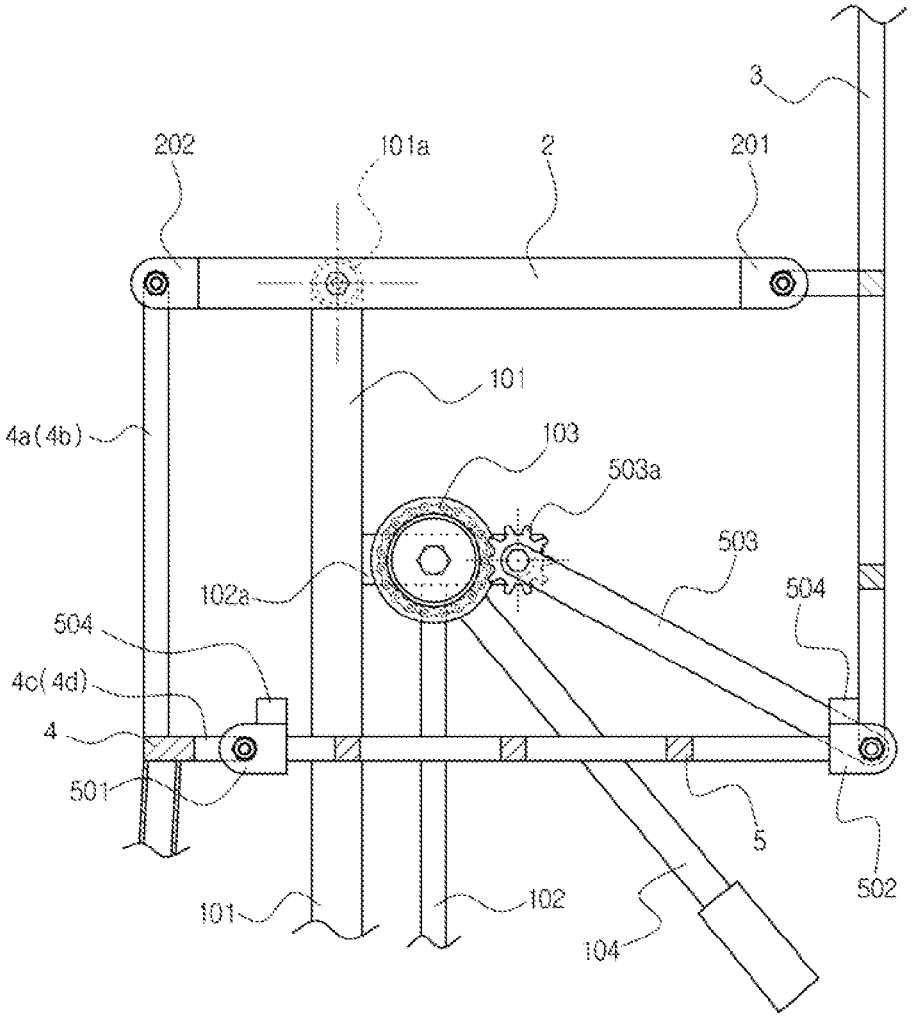
FIG. 3 is a magnified view illustrating a first gear manually operated according to an embodiment of the present invention.
Figure 4:
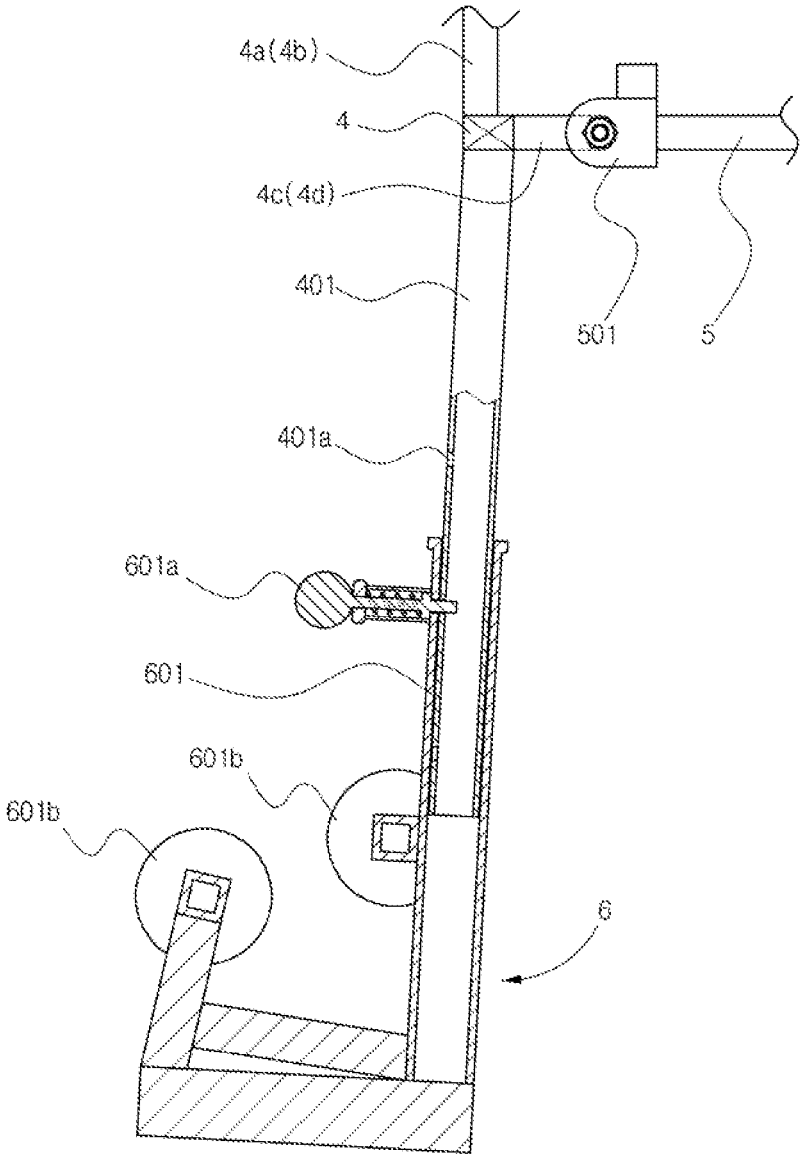
FIG. 4 is a cross-sectional view of a footrest of FIG. 1.

Hereinafter, exemplary embodiments will be described in detail with reference to the accompanying drawings. Throughout the drawings and the detailed description, unless otherwise described, the same drawing reference numerals will be understood to refer to the same elements, features, and structures. The relative size and depiction of these elements may be exaggerated for clarity, illustration, and convenience. The following detailed description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. Also, descriptions of well-known functions and constructions may be omitted for increased clarity and conciseness.

It is also noted that like reference numerals denote like elements in appreciating the drawings. Moreover, detailed descriptions related to well-known functions or configurations will be ruled out in order not to unnecessarily obscure subject matters of the present invention.

A rocking chair according to an exemplary embodiment of the present invention may include a first support 101 and a second support 102 which are parallelly disposed in a vertical direction at central portions of both stands 1. The first support 101 may be longer than the second support 102.

A pivot 101*a* may be disposed on the upper end portion of the first support 101 such that an armrest 2 can pivot on the pivot 101*a*.

In this case, a first connector 201 may be disposed at a rear end portion of the armrest 2 such that connectors disposed at left and right sides of the central portion of a backrest 3 having a rectangular frame structure can pivot. Also, a second connector 202 may be disposed at a front end portion of the armrest 2 such that the upper end portion of vertical connection rods 4*a* and 4*b* disposed at left and right sides of a horizontal connection rod 4 can pivot.

Accordingly, when the armrest 2 pivotably disposed on the upper end portion of the first support 101 pivots, the backrest 3 pivotably connected to the first connector 201 disposed at the rear end portion of the armrest 2, and the horizontal connection rod 4 pivotably connected to the second connector 202 disposed at the front end portion of the armrest 2 may be simultaneously pivoted. Also, a seat rod 5 may be disposed at the lower end portions of the backrest 3 and the horizontal connection rod 4.

In other words, a third connector 501 may be disposed at the front end portion of the seat rod 5 so as to be pivotably connected to the lower end portions of the vertical connection rods at the left and right sides of the horizontal connection rod 4, and a fourth connector 502 may be disposed at the rear end portion of the seat rod 5 so as to be pivotably connected to the left and right lower end portions of the backrest 3. Also, a rotational link 503 may connect between the fourth connector 502 and the upper end portion of the second support 102, forming a four joint link structure in which the armrest 2, the backrest 3, the horizontal connection rod 4, and the seat rod 5 are pivotably connected to each other by the first connector 201, the second connector 202, the third connector 501, and the fourth connector 502.

Accordingly, when the armrest 2 pivotably disposed on the pivot 101*a* formed on the upper end portion of the first support 101 formed over the stand 1 pivots on the pivot 101*a*, the armrest 2, the backrest 3, the horizontal connection rod 4, and the seat rod 5 may simultaneously pivot.

On the other hand, the lower portion of the horizontal connection rod 4 may have a square pipe shape, and a fixing rod 401 having fixing holes 401*a* may be formed integrally with the lower portion of the horizontal connection rod 4. Also, a footrest 6 may be disposed on the fixing rod 401.

That is, the horizontal connection rod 4 may be formed with a square pipe such that the fixing rod 401 can be inserted into the horizontal connection rod 4. Also, a coupling rod 601 elastically installed with a fixing pin 601*a* that is inserted into the fixing hole 401*a* formed in the fixing rod 401 to fix the position may be coupled to the fixing rod 401 to be fixed at a desired location. In this case, four ankle fixing rollers 601*b* may be disposed at certain intervals under the coupling rod 601 such that a user can hang his/her ankles thereon. A foothold 601*c* may be disposed at both sides of the lower end portion of the coupling rod 601, forming the footrest 6 and thus allowing a user to put his/her feet on the foothold 601*c* when the user is sitting on the seat rod 5. When a user performs inversion exercise, the user can fix both ankles with the ankle fixing rollers 601*b* of the footrest 6.

Figure 5:
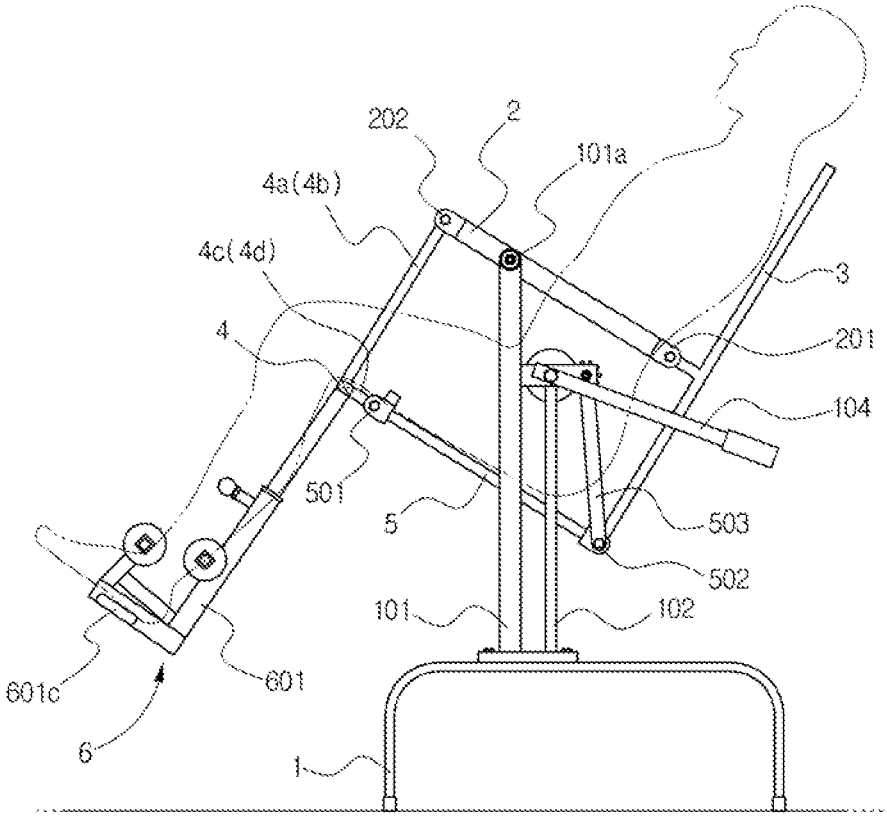
FIGS. 5 and 6 are views illustrating an operation process for inversion exercise according to an embodiment of the present invention.

Accordingly, as shown in FIG. 5, when a user sits on the seat rod 5, the armrest 2, the backrest 3, the horizontal connection rod 4, and the seat rod 5 having the four joint link structure may pivot by the center of gravity of the user.

In other words, since the installation part of the armrest 2 pivotably disposed on the pivot 101*a* formed on the upper end portion of the first support 101 is located at the front side of the center based on the whole length of the armrest 2, the center of gravity of the seat rod 5 and the backrest 3 may be located at the rear side. Thus, when a user sits on the seat rod 5 while leaning on the backrest 3, the chair may naturally lean to the rear side by the center of gravity, maintaining a comfortable posture.

Also, since the armrest 2, the backrest 3, the horizontal connection rod 4, and the seat rod 5 which have the four joint link structure are stably supported as shown in the drawing, the chair can naturally perform a function like a rocking chair.

Figure 6:
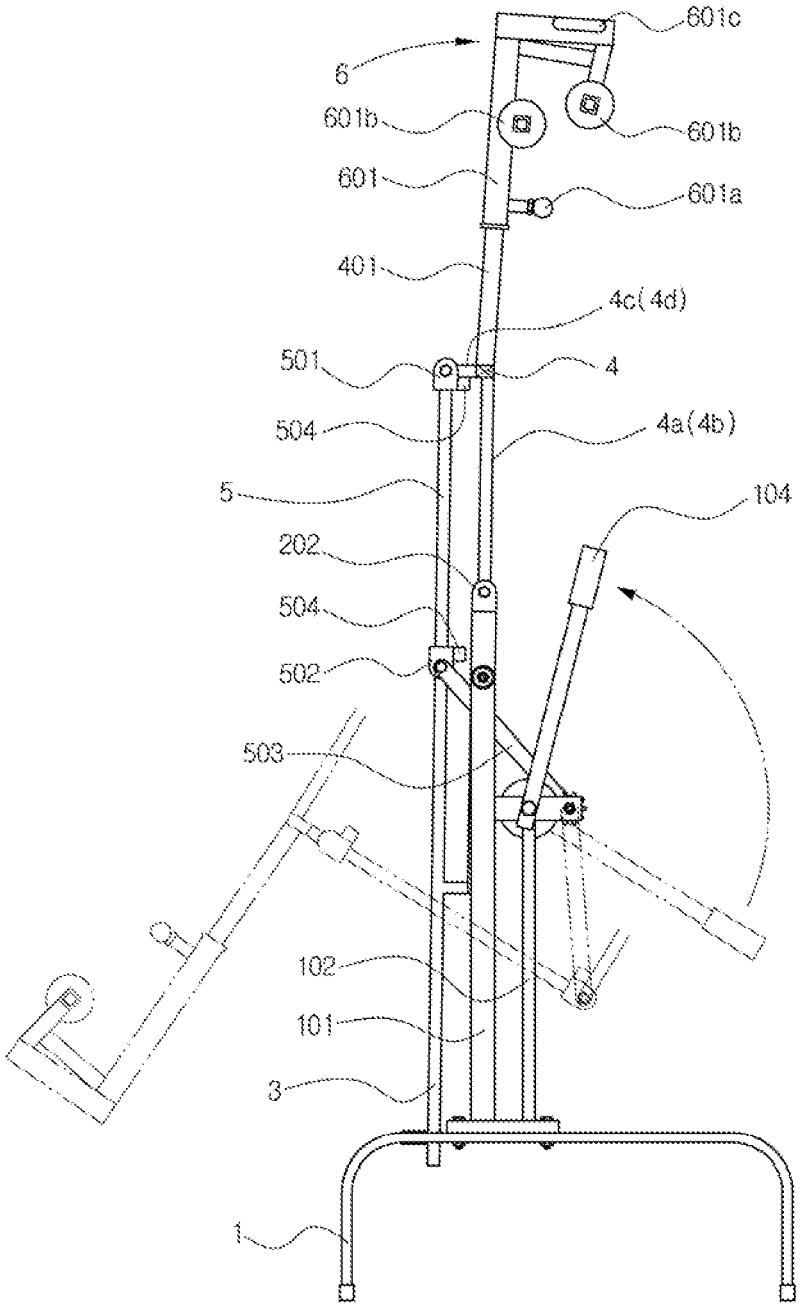
Figure 7:
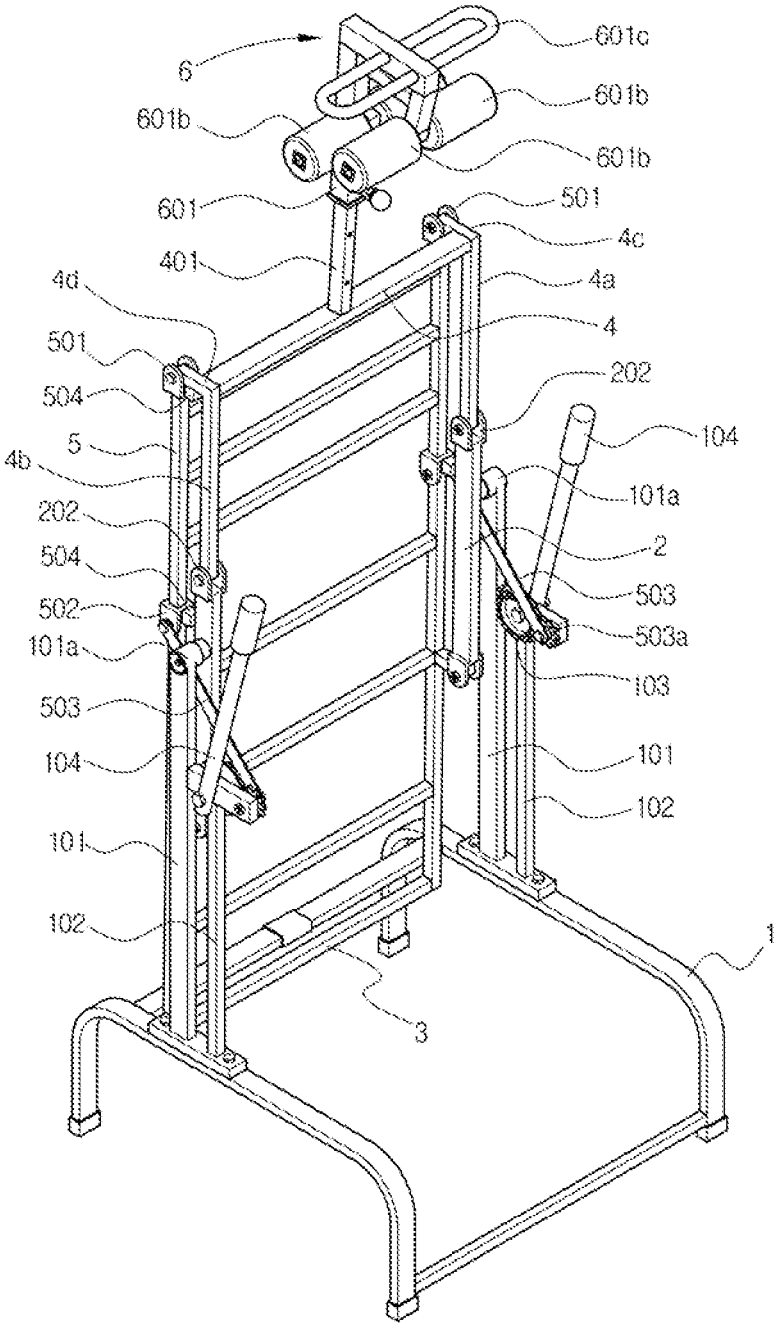
FIG. 7 is a perspective view illustrating an inversion exercise apparatus transformed from a chair.
Figure 8:
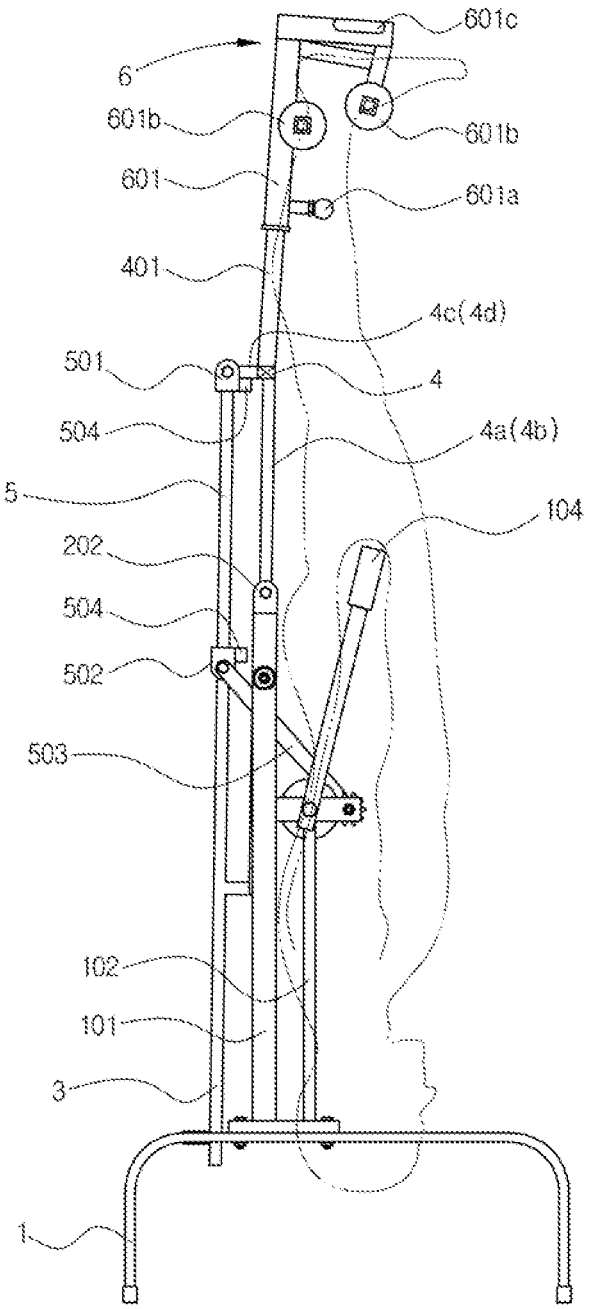
FIG. 8 is a side view of FIG. 7.

On the other hand, when a user pulls up and rotates an operation lever 104 while fixing both ankles in the ankle fixing rollers 601*b* of the footrest 6, as shown in FIGS. 6 to 8, the footrest 6 may move up and the backrest 3 may move down, allowing all of the armrest 2, the backrest 3, the horizontal connection rod 4 and the seat rod 5 which have the four joint link structure to rotate and stand in a vertical direction.

Accordingly, a user who is fixing both ankles in the ankle fixing rollers 601*b* of the footrest 6 may hang upside down as shown in FIG. 8, performing inversion exercise.

In this case, as shown in FIG. 5, since the armrest 2, the backrest 3, the horizontal connection rod 4 and the seat rod 5 which have the four joint link structure may spread straight by the rotation of the link structure from the rectangular shape, the chair may be transformed into an inversion exercise apparatus, minimizing the radius of rotation necessary for the rotation for conversion into the inversion exercise apparatus.

Also, during the performance of the inversion exercise, when a user reversely moves the operation lever 104 disposed at the upper end portion of the second support 102 and erects himself/herself, a first gear may be reversed, allowing the armrest 2, the backrest 3, the horizontal connection rod 4 and the seat rod 5 which have the four joint link structure to return to the rectangular shape as shown in FIG. 5 and thus enabling a user to conveniently finish the inversion exercise.

Figure 9:
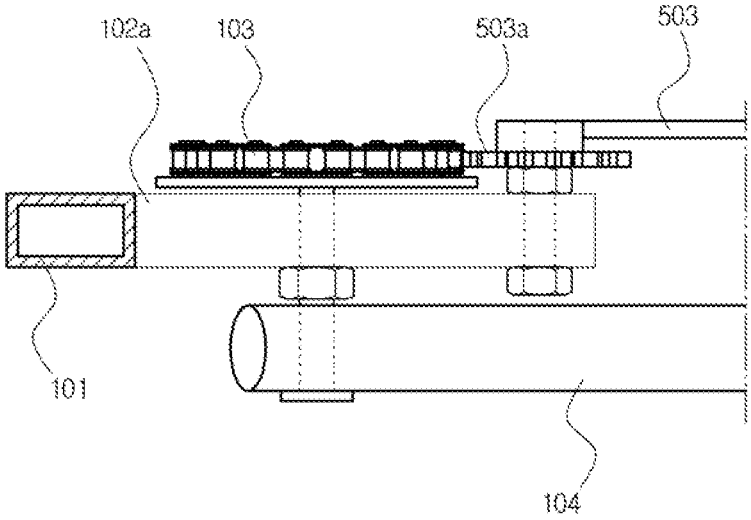
FIG. 9 is a plan view illustrating an engagement of a first gear and a second gear.
Figure 10:
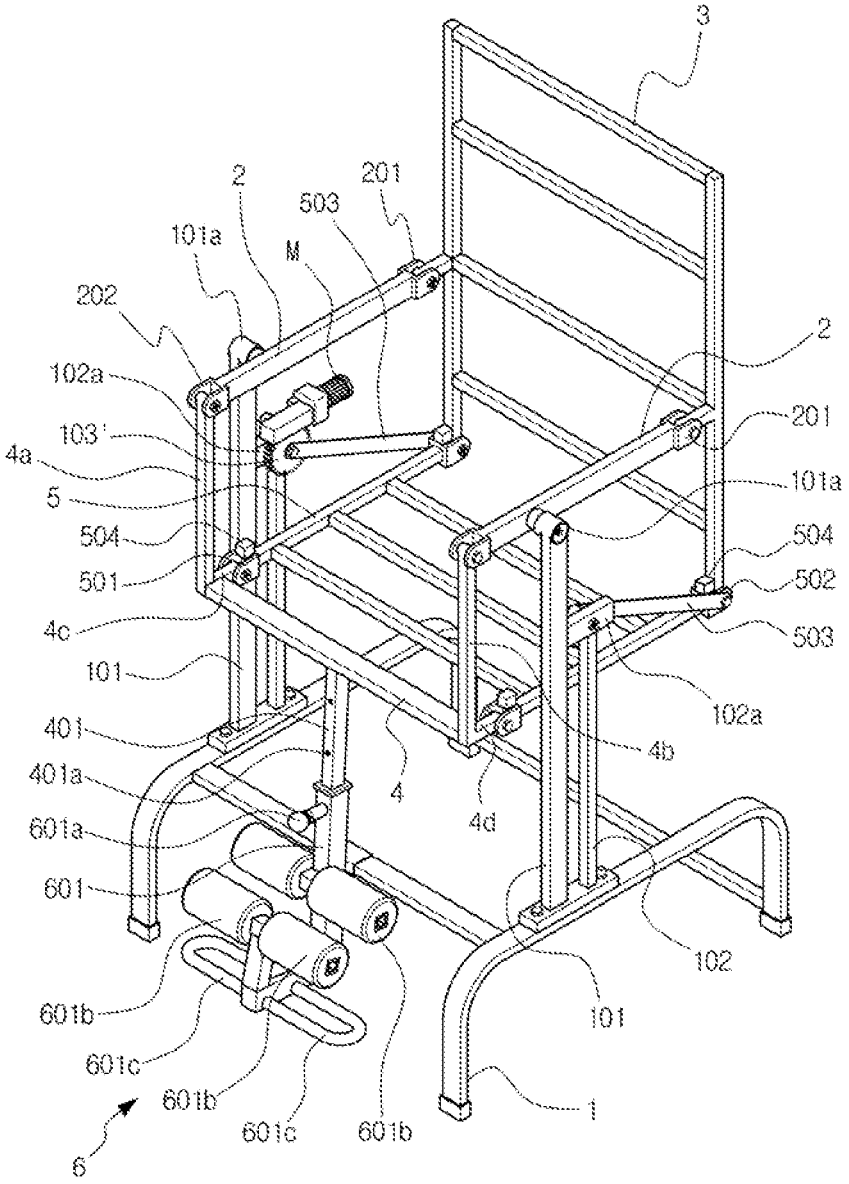
FIG. 10 is a perspective view illustrating a geared motor mounted in a first gear.
Figure 11:
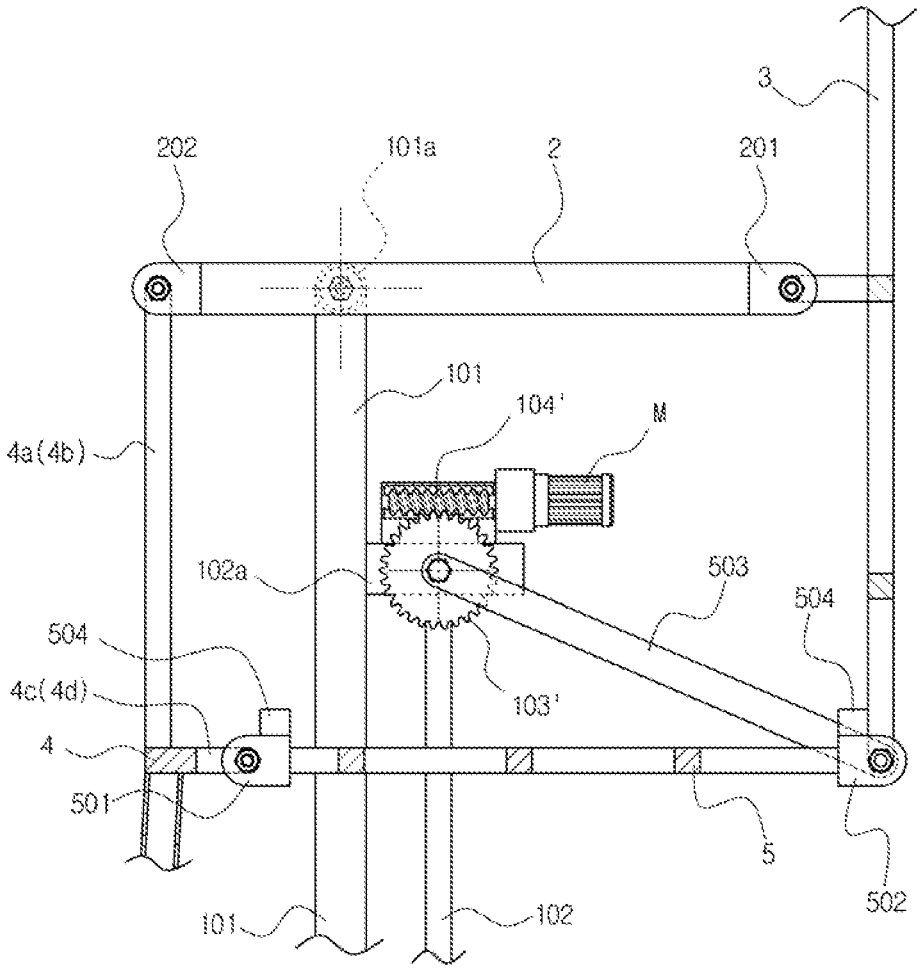
FIG. 11 is a magnified view of the first gear of FIG. 10.
Figure 12:
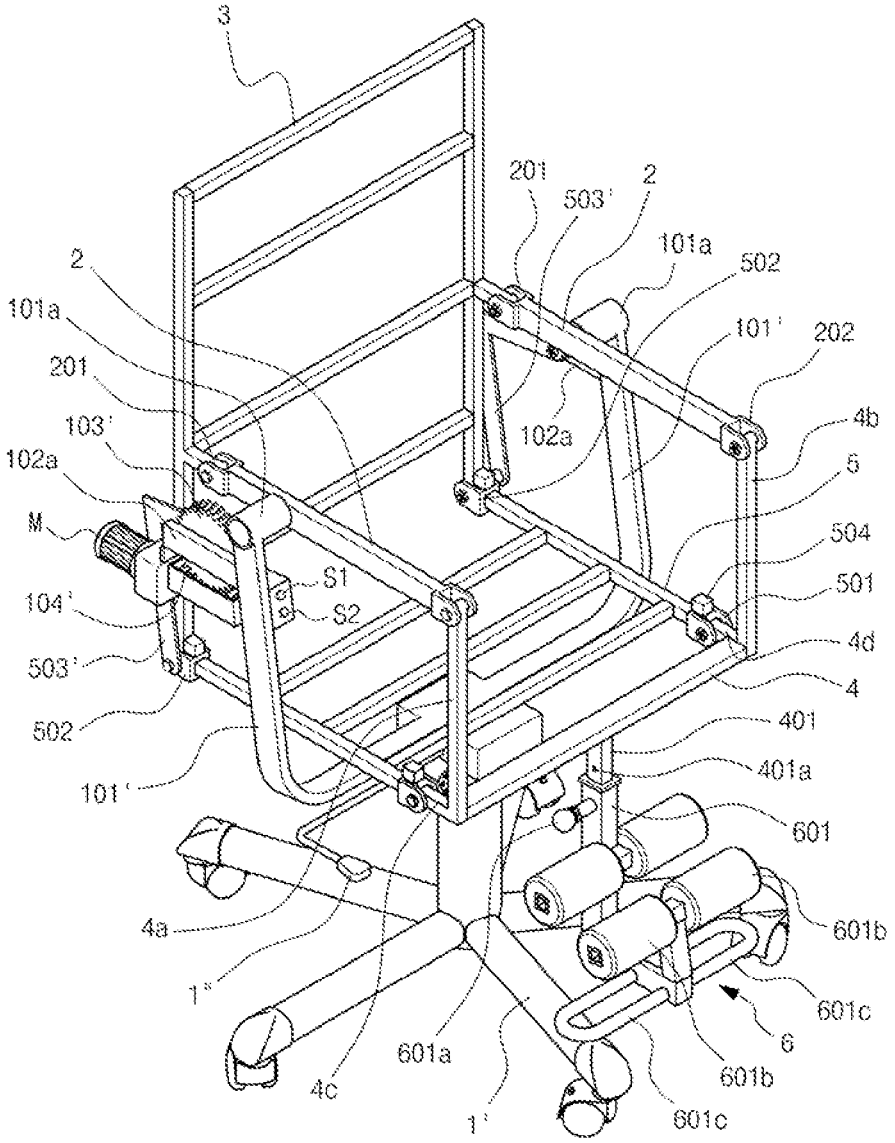
FIG. 12 is a view illustrating an inversion exercise apparatus implemented into a swivel chair according to an embodiment of the present invention.
Figure 13:
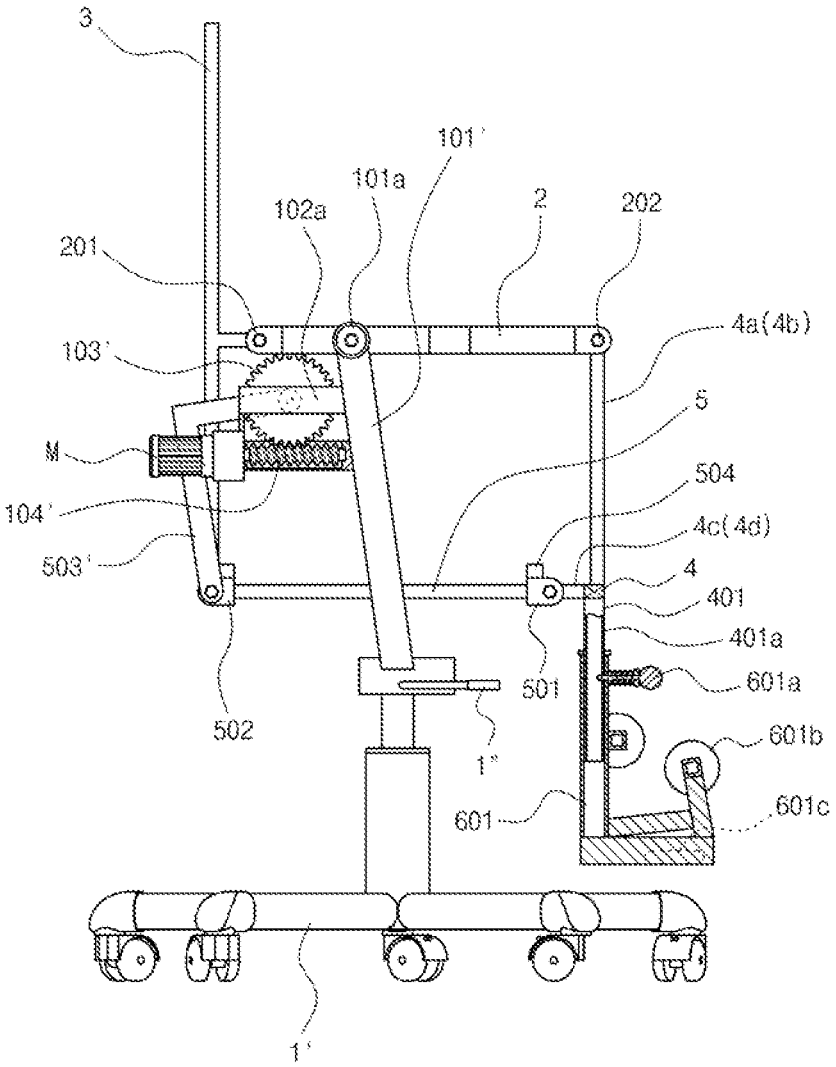
FIG. 13 is a side view of FIG. 12.
Figure 14:
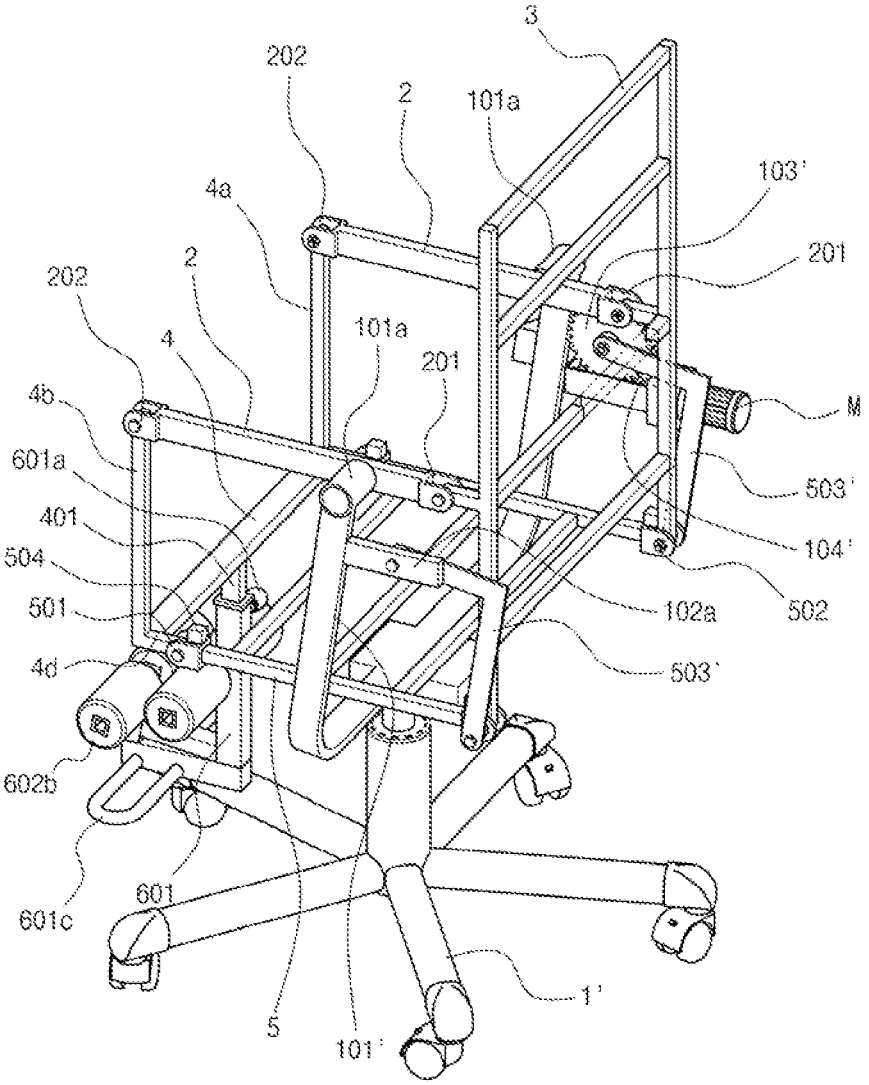
FIG. 14 is a perspective rear view of FIG. 12.
Figure 15:
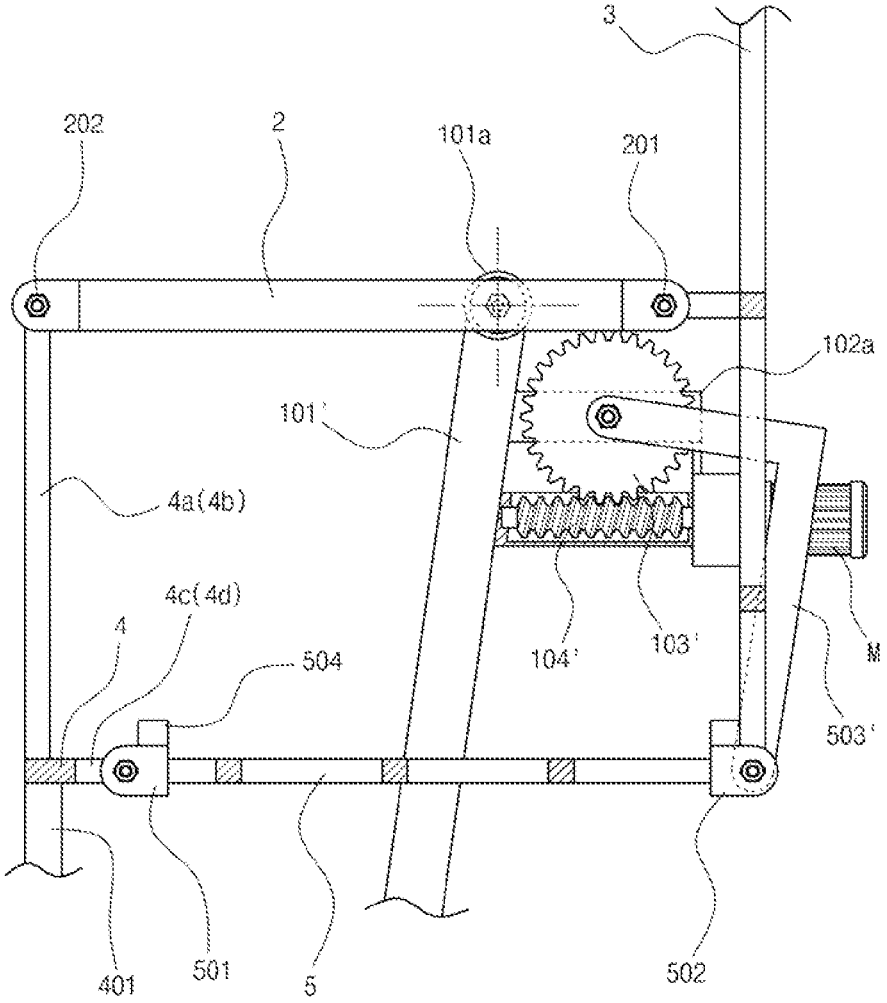
FIG. 15 is a magnified view illustrating a first gear driving device of FIG. 12.
Figure 16:
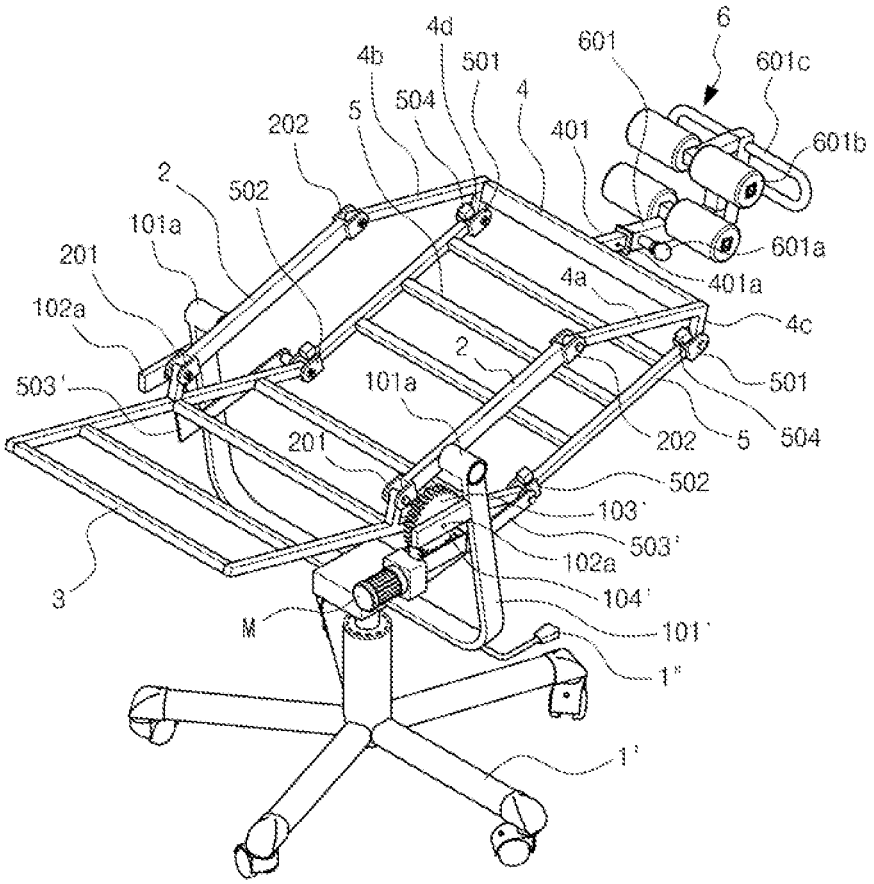
FIG. 16 is a perspective view illustrating a process of transforming the swivel chair of FIG. 12 into an inversion exercise apparatus.
Figure 17:
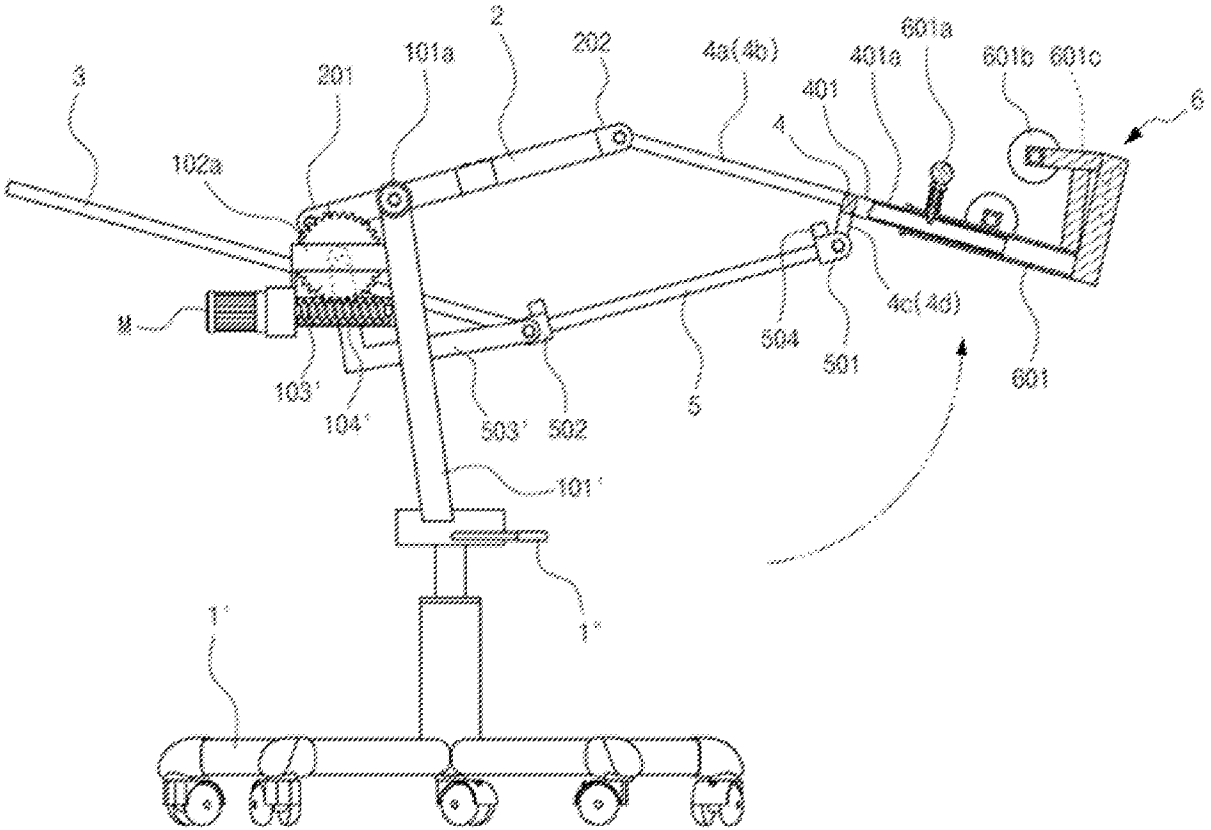
FIG. 17 is a side view of FIG. 16.
Figure 18:
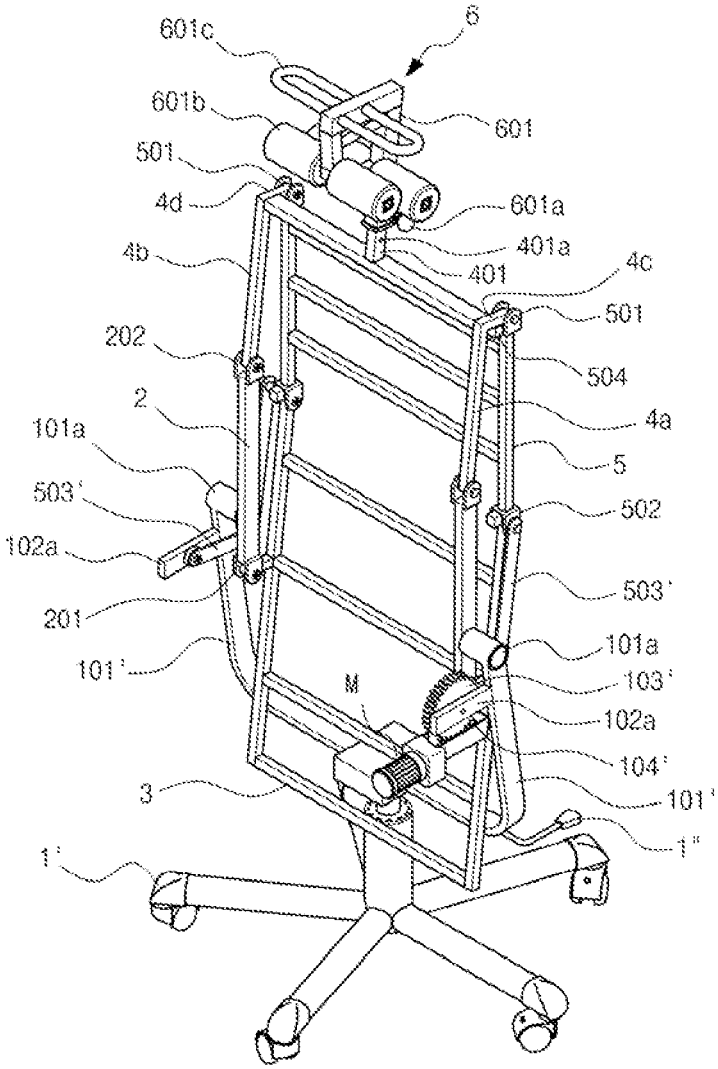
FIG. 18 is a perspective view illustrating an inversion exercise apparatus transformed from a chair.
Figure 19:
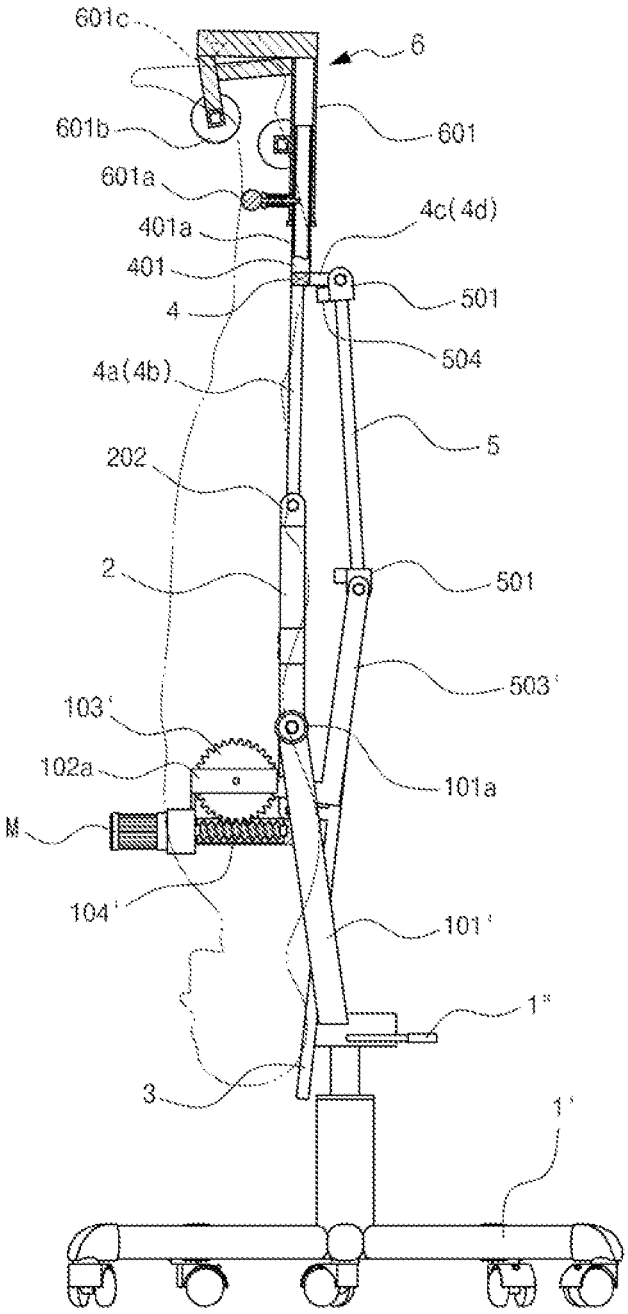
FIG. 19 is a view illustrating a use state of the inversion exercise apparatus of FIG. 18.

On the other hand, as shown in FIG. 9, a rotation axis may be disposed on the upper end portion of the second support 102, and a first gear 103 may be disposed so as to be fixed to the rotation axis. The operation lever 104 may be disposed on the outer side surface of the bracket 102*a* opposite to the first gear 103 so as to be formed integrally with the rotation axis in addition to the first gear 103. The rotational link 503 may have one end portion thereof pivotably connected to the fourth connector 502. Also, a second gear 503*a* may be disposed at one side of the bracket 102*a* so as to integrally pivot with the other end portion of the rotational link 503 and engage with the first gear 103. Thus, when a user pulls or pushes the operation lever 104 to perform inversion exercise, the torque may be delivered to the seat rod 5 through the link, allowing the armrest 2, the backrest 3, the horizontal connection rod 4 and the seat rod 5 having the four joint link structure to simultaneously pivot and thus transform into the inversion exercise apparatus.

Also, as shown in the drawing, instead of general gears, the first gear 103 may be replaced with a chain fixed on the outer circumference of a disc, and the second gear 503*a* may be replaced with a chain sprocket to save the manufacturing cost of gears.

Meanwhile, a gap maintaining member 504 may be integrally formed on the third connector 501 and the fourth connector 502 so as to protrude therefrom. Thus, when the armrest 2, the backrest 3, the horizontal connection rod 4 and the seat rod 5 having the four joint link structure spread in a straight line, the armrest 2 or the backrest 3, or the horizontal connection rod 4 or the seat rod 5 may not adhere closely to each other and may be spaced away from each other by a gap of the gap maintaining member 504. Accordingly, a portion of user's body can be prevented from being caught in a gap between the armrest 2, the backrest 3, the horizontal connection rod 4 and the seat rod 5.

On the other hand, the first gear may be configured with a worm wheel, and may make contact with a worm screw of a left-right rotation type geared motor M with a left-right rotation switch. Thus, the backrest and the seat rod may be electrically operated without the operation lever 104.

In an embodiment, the present invention may be implemented into a swivel chair. In this case, a first support 101' may be disposed at both sides of a swivel chair stand 1', and the upper end of the first support 101' may be fixed so as to lean to a backrest 3 by about 5 degrees to about 6 degrees. A pivot 101*a* may be disposed on the upper end portion of the first support 101' such that an armrest 2 can pivot on the pivot 101*a*. An intermediate connector of the backrest 3 may be connected to the first connector 201 disposed at a rear end portion of the armrest 2, and the upper end portion of vertical connection rods 4*a* and 4*b* disposed at left and right sides of a horizontal connection rod 4 may be connected to a second connector 202 disposed at a front end portion of the armrest 2. A seat rod 5 may be disposed at the lower end portions of the backrest 3 and at the lower end portions 4*c* and 4*d* of the vertical connection rod, and the lower end portions of the left and right vertical connection rods of the horizontal connection rod 4 may be pivotably connected to a third connector 501 disposed at the front end portion of the seat rod 5. A fourth connector 502 may be disposed at the rear end portion of the seat rod 5 such that the left and right lower end portions of the backrest 3 can pivot, and a fixing rod 401 may be disposed under the horizontal connection rod 4 to be coupled to a coupling rod 601. A footrest 4 including four ankle fixing rollers 601*b* and a foothold 601*c* may be disposed under the coupling rod 601. A bracket 102*a* may be disposed under the pivot 101*a* of the first support 101', and may protrude toward the backrest 3. A rotational link 503' having an L-shape may be disposed between the rotation axis of the bracket 102*a* and the fourth connector 502. A first gear disposed on the rotation axis of one bracket may be configured with a worm wheel 103' which makes contact with a worm screw 104' of a left-right rotation type geared motor M equipped with a left-right rotation switch S1 or S2. Thus, the backrest 3 and the seat rod 5 can be operated by an electric device without an operation lever, and the present invention can be implemented in a swivel chair.

In the drawings, the reference numeral 1" that is unexplained may be an operation lever for adjusting the height of the swivel chair.

While this invention has been particularly shown and described with reference to preferred embodiments thereof, it will be understood by those skilled in the art that various changes in form and details may be made therein without departing from the spirit and scope of the invention as defined by the appended claims. The preferred embodiments should be considered in descriptive sense only and not for purposes of limitation. Therefore, the scope of the invention is defined not by the detailed description of the invention but by the appended claims, and all differences within the scope will be construed as being included in the present invention.

The invention claimed is:

1. An inversion exercise apparatus having a chair function, comprising:

a stand comprising a pair of first supports and a pair of second supports parallelly disposed in a vertical direction at both left and right sides of the stand, the first supports being longer than the second supports;

an armrest pivotably coupled to an upper end portion of each of the first supports, the armrests comprising a pair of first connectors disposed at a rear end portion of the respective armrest and pivotably connected to connectors disposed at left and right sides of a central portion of a backrest having a rectangular frame structure, and comprising a pair of second connectors disposed at a front end portion of the respective armrest and pivotably connected to upper end portions of a pair of vertical connection rods disposed at left and right sides of a horizontal connection rod at a front side of a seat;

the pair of vertical connection rods having lower connectors that are pivotably connected to a pair of third connectors;

the seat comprising a pair of seat rods, the pair of third connectors disposed at front end portions of the pair of seat rods and pivotably connected to the lower connectors of the pair of vertical connection rods and comprising a pair of fourth connectors disposed at rear end portions of the pair of seat rods and pivotably connected to left and right lower end portions of the backrest;

a pair of rotational links connected to the pair of fourth connectors and a pair of brackets of the first supports;

a pair of gap maintaining members disposed on the pair of third connectors and a pair of gap maintaining members disposed on the pair of the fourth connectors;

a footrest comprising a fixing rod disposed in a vertical direction under the horizontal connection rod and having fixing holes at a certain interval, the fixing rod inserted into a coupling rod, a fixing pin inserted into one of the fixing holes to fix a location of the coupling rod, four ankle fixing rollers disposed at certain intervals under the coupling rod, and a pair of footholds disposed under the coupling rod;

a pair of first gears rotatably connected to the pair of brackets of the first supports;

a pair of operation levers that rotate integrally with the pair of first gears; and a pair of second gears disposed on the pair of brackets of the first supports and arranged to engage the pair of first gears.

2. The inversion exercise apparatus of claim 1, wherein each of the pair of first gears comprises a disc and a chain fixedly covering an outer circumference of the disc, and each of the pair of second gears comprises a chain sprocket.

3. An inversion exercise apparatus having a swivel chair function, comprising:

a swivel chair stand;

a pair of first supports coupled to the swivel chair stand;

an armrest pivotably coupled to an upper end portion of each of the first supports, the armrests comprising a pair of first connectors disposed at a rear end portion of the respective armrest and pivotably connected to connectors disposed at left and right sides of a central portion of a backrest having a rectangular frame structure, and comprising a pair of second connectors disposed at a front end portion of the respective armrest and pivotably connected to upper end portions of a pair of vertical connection rods disposed at left and right sides of a horizontal connection rod at a front side of a seat;

the pair of vertical connection rods having lower connectors that are pivotably connected to a pair of third connectors;

the seat comprising a pair of seat rods, the pair of third connectors disposed at front end portions of the pair of seat rods and pivotably connected to the lower connectors of the pair of vertical connection rods and comprising a pair of fourth connectors disposed at rear end portions of the pair of seat rods and pivotably connected to left and right lower end portions of the backrest;

a pair of rotational links connected to the pair of fourth connectors and a pair of brackets of the first supports;

a pair of gap maintaining members disposed on the pair of third connectors and a pair of gap maintaining members disposed on the pair of the fourth connectors;

a footrest comprising a fixing rod disposed in a vertical direction under the horizontal connection rod and having fixing holes at a certain interval, the fixing rod inserted into a coupling rod, a fixing pin inserted into one of the fixing holes to fix a location of the coupling rod, four ankle fixing rollers disposed at certain intervals under the coupling rod, and a pair of footholds disposed under the coupling rod;

a worm wheel rotatably connected to one of the pair of brackets of the first supports;

a worm screw engaging the worm wheel; and a motor including a drive shaft coupled to the worm screw and a control switch.

4. The inversion exercise apparatus of claim 3, wherein the pair of first supports are configured to lean toward the backrest by about 5 degrees to about 6 degrees.

5. An inversion exercise apparatus having a chair function, comprising:

a stand comprising a pair of first supports and a pair of second supports parallelly disposed in a vertical direction at both left and right sides of the stand, the first supports being longer than the second supports;

an armrest pivotably coupled to an upper end portion of each of the first supports, the armrests comprising a pair of first connectors disposed at a rear end portion of the respective armrest and pivotably connected to connectors disposed at left and right sides of a central portion of a backrest having a rectangular frame structure, and comprising a pair of second connectors disposed at a front end portion of the respective armrest and pivotably connected to upper end portions of a pair of vertical connection rods disposed at left and right sides of a horizontal connection rod at a front side of a seat;

the pair of vertical connection rods having lower connectors that are pivotably connected to a pair of third connectors;

the seat comprising a pair of seat rods, the pair of third connectors disposed at front end portions of the pair of seat rods and pivotably connected to the lower connectors of the pair of vertical connection rods and comprising a pair of fourth connectors disposed at rear end portions of the pair of seat rods and pivotably connected to left and right lower end portions of the backrest;

a pair of rotational links connected to the pair of fourth connectors and a pair of brackets of the first supports;

a pair of gap maintaining members disposed on the pair of third connectors and a pair of gap maintaining members disposed on the pair of the fourth connectors;

a footrest comprising a fixing rod disposed in a vertical direction under the horizontal connection rod and having fixing holes at a certain interval, the fixing rod inserted into a coupling rod, a fixing pin inserted into one of the fixing holes to fix a location of the coupling rod, four ankle fixing rollers disposed at certain intervals under the coupling rod, and a pair of footholds disposed under the coupling rod;

a worm wheel rotatably connected to one of the pair of brackets of the first supports;

a worm screw engaging the worm wheel; and a motor including a drive shaft coupled to the worm screw and a control switch.

* * * * *